United States Patent [19]

Hwang et al.

[11] Patent Number: 4,554,788

[45] Date of Patent: Nov. 26, 1985

[54] TURBINE VALVE CONTROL SYSTEM

[75] Inventors: Eddie Y. Hwang, Winter Park, Fla.; Andras I. Szabo, Murrysville, Pa.; Wu-shi Shung, South Windsor, Conn.

[73] Assignee: Westinghouse Electric Corp., Pittsburgh, Pa.

[21] Appl. No.: 564,062

[22] Filed: Dec. 21, 1983

[51] Int. Cl.[4] ..... F01K 13/00

[52] U.S. Cl. ..... 60/646; 60/657; 60/660; 91/429

[58] Field of Search ..... 60/646, 657, 660; 415/118, 15, 17, 36; 91/429

[56] References Cited

U.S. PATENT DOCUMENTS

| | | | |
|---|---|---|---|
| 3,462,115 | 8/1969 | Barker | 91/429 |
| 3,836,822 | 9/1974 | Schonfeld | 60/660 X |
| 4,059,960 | 11/1977 | Osborne | 60/657 X |
| 4,262,784 | 4/1981 | Sibeud | 91/429 |
| 4,368,520 | 1/1983 | Hwang et al. | 60/646 X |

*Primary Examiner*—Allen M. Ostrager
*Attorney, Agent, or Firm*—D. Schron

[57] ABSTRACT

Hydraulically operated turbine steam admission valves wherein each valve has its own microcomputer control. In the event the valve gets stuck due to possible contamination in the hydraulic system, the microcomputer control provides an oscillatory control signal to dither the valve. If the valve remains stuck after dithering action it is provided with a control signal of an initial magnitude greater than that normally required to close the valve.

17 Claims, 8 Drawing Figures

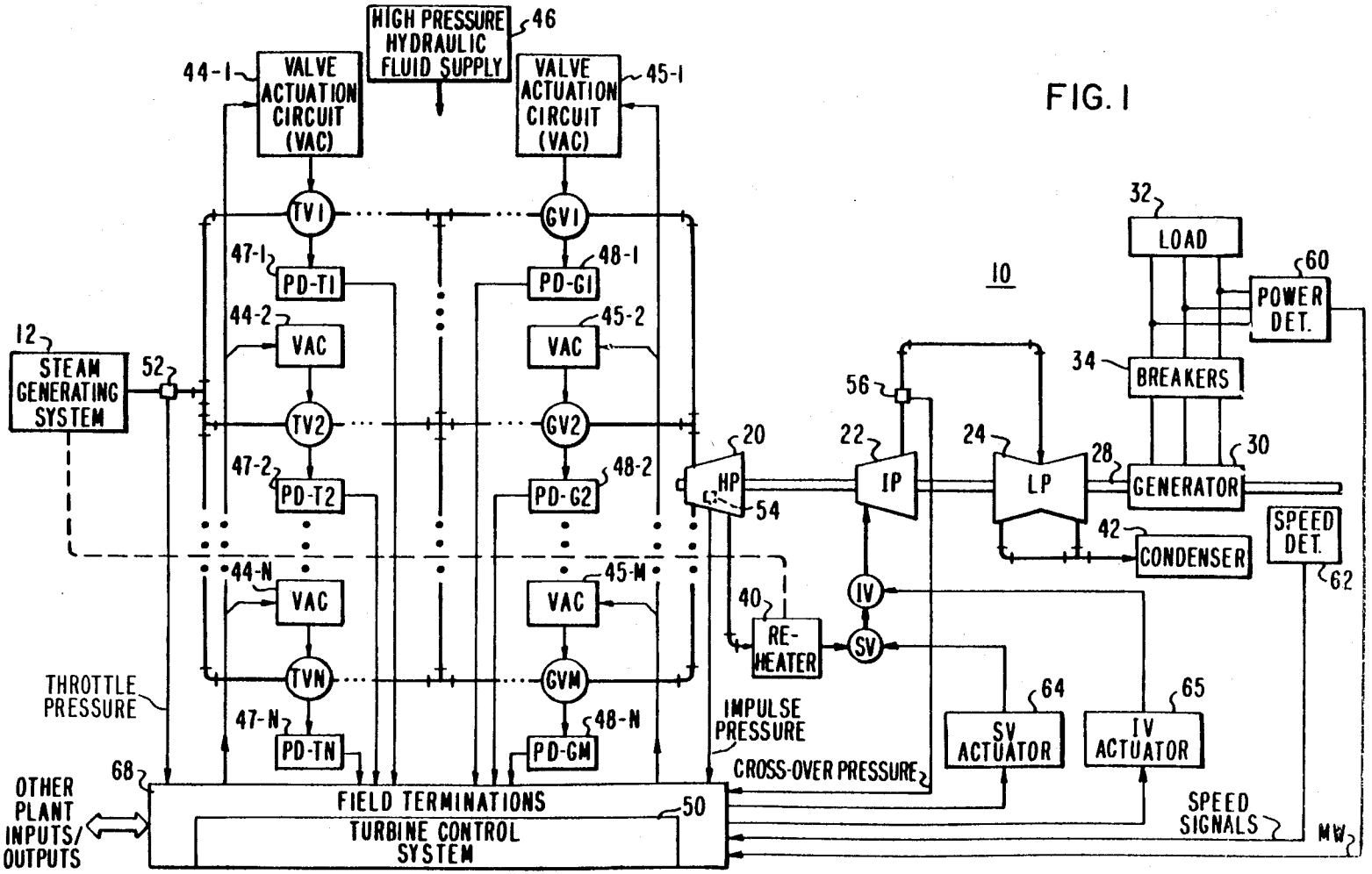
FIG. 1
10
LOAD
32
POWER DET.
60
BREAKERS
34
GENERATOR
30
SPEED DET.
62
MW
SPEED SIGNALS
CONDENSER
42
LP
28
24
IP
22
56
HP
20
54
RE-HEATER
40
IV
SV
IV ACTUATOR
65
SV ACTUATOR
64
IMPULSE PRESSURE
CROSS-OVER PRESSURE
50
FIELD TERMINATIONS
TURBINE CONTROL SYSTEM
68
OTHER PLANT INPUTS/ OUTPUTS
THROTTLE PRESSURE
STEAM GENERATING SYSTEM
12
52
HIGH PRESSURE HYDRAULIC FLUID SUPPLY
46
VALVE ACTUATION CIRCUIT (VAC)
44-1
45-1
TV1
GV1
PD-T1
PD-G1
47-1
48-1
VAC
44-2
45-2
TV2
GV2
PD-T2
PD-G2
47-2
48-2
VAC
44-N
45-N
TVN
GVN
PD-TN
PD-GN
47-N
48-N

TURBINE VALVE CONTROL SYSTEM

BACKGROUND OF THE INVENTION

1. Field of the Invention

The invention in general relates to steam turbine control systems and more particularly to improved operation of the steam admission valves thereof.

2. Description of the Prior Art

In the field of steam turbine control, many systems exist which utilize a primary controller in the form of a programmable digital computer as well as a redundant or backup computer. The computer's capability to monitor, memorize, calculate, test and make instant decisions results in a control system which is faster, more accurate and far superior to purely mechanical or analog control systems.

An improved digital control system for a steam turbine has been developed which includes primary and redundant base controllers as well as interconnected and coordinated functional modules each having its own microcomputer to execute specific functions. That is, the control system structure is based upon distributed processing, with this modular architecture providing for greater flexibility and minimizing risk of control loss and total system shutdown due to any single failure. The system can be serviced while on-line without the necessity for shutting down the turbine's operation and servicing of the apparatus can be accomplished in a minimal amount of time. One example of such distributed processing turbine control system is described and claimed in U.S. Pat. No. 4,368,520 assigned to the assignee of the present invention and hereby incorporated by reference.

The control system of the referenced patent includes a plurality of valve position control circuits for controlling the steam admission valves, with each circuit including its own programmable digital computer in two-way digital communication with a base controller from which it receives signals relative to the individual valve control. The valve position control circuits are selectively addressable to receive a particular valve related signal from the controller to in turn generate an individual valve drive signal for the valve it is controlling. The system is operable both in an automatic and a manual mode and when in the manual mode all of the valve position control circuits function to receive operator-entered command signals.

The valve drive signal is utilized to position a hydraulically actuated steam admission valve which may respond sluggishly or even stick as the result of possible dirt contamination of the high-pressure hydraulic fluid.

Although such dirt contamination may never occur in the operating life of the turbine control system, its possibility must be taken into account in order to provide for a highly efficient and highly reliable system. The present invention provides for normal smooth valve control with contingency operation in the event of a stuck valve.

SUMMARY OF THE INVENTION

The control system includes a control means for providing a normal control signal to govern the opening and closing of the valve. If the valve gets stuck an oscillatory signal such as a square wave is cyclically superimposed on the control signal in an attempt to unstick the valve. If such operation is unsucessful the valve is commanded shut.

BRIEF DESCRIPTION OF THE DRAWINGS

FIG. 1 is a block diagram of a steam turbine-generator power plant;

DESCRIPTION OF THE PREFERRED EMBODIMENT

Figure 2:
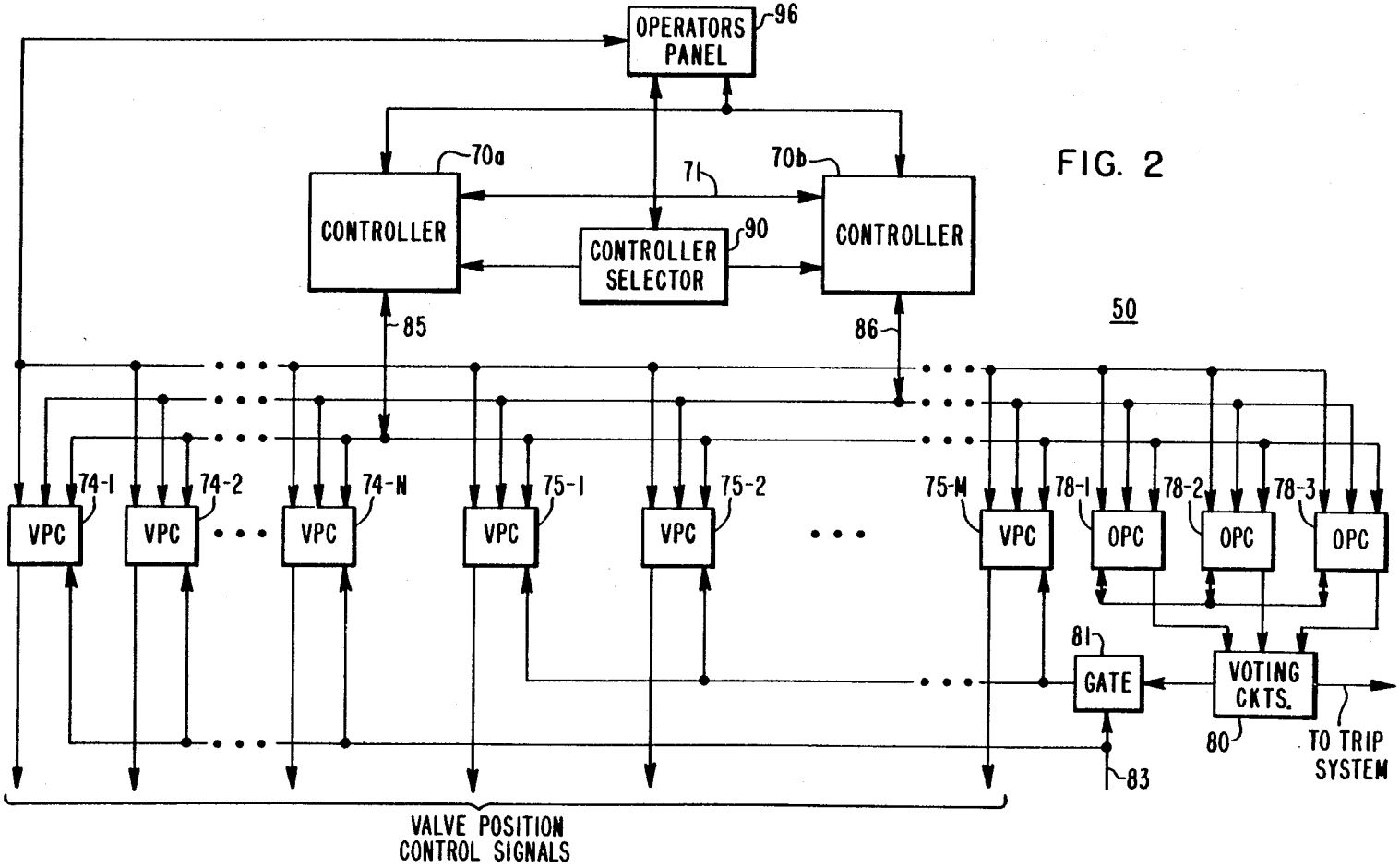
FIG. 2 is a block diagram of the turbine control system illustrated in FIG. 1.

FIG. 1 depicts a steam turbine-generator power plant and is illustrated as a fossil-fired, tandem compound, single reheat turbine-generator unit by way of example. The arrangement includes a plurality of steam admission valves such as throttle valve TV1–TVN and governor valves GV1–GVM disposed in the main steam header which couples a steam turbine system 10 to a steam generating system 12. In a typical arrangement there may be four throttle valves (N=4) and eight governor valves (M=8).

Turbine system 10 includes a high pressure (HP) turbine 20, an intermediate pressure (IP) turbine 22 and a low pressure (LP) turbine 24, all of which are coupled to a common shaft 28 to drive an electrical generator 30 which supplies power to a load 32 through main breakers 34.

Steam exiting the HP turbine 20 is normally reheated in a reheater unit 40 generally a part of steam generating system 12 as indicated by the dotted line connection. Reheated steam is supplied to IP turbine 22 through one or more stop valves SV and one or more interceptor valves IV disposed in the steam line. Steam from the IP turbine 22 is provided to LP turbine 24 from which the steam is exhausted into a conventional condenser 42.

With the main breakers 34 open, the torque as produced by the inlet steam, is used to accelerate the turbine shaft 28 from turning gear to synchronous speed. As long as the main breakers 34 are open, the turbine is spinning with no electrical load and it is operative in a speed control mode. Once the shaft frequency is synchronized to the frequency of the load 32, which may be a power system network, the breaker 34 are closed, and power is delivered to the load by the generator 30. When the breakers 34 close, the net torque exerted on the turbine rotating assemblies of the HP, IP and LP turbines controls the amount of power supplied to the load 32, while shaft speed is governed by the frequency of the power system network. Control of steam inlet under these conditions is generally referred to as load control, during which the turbine speed is monitored for purposes of regulating the power delivered to the load 32.

In order to control the turbine during operation, the steam admitting throttle and governor valves are controlled in position by respective valve actuation circuits 44 and 45 which receive high pressure fluid from a high pressure hydraulic fluid supply 46. Thus, valve actuation circuits 44-1 through 44-N respectively control throttle valves TV1–TVN and valve actuation circuits 45-1 through 45-M control governor valves GV1–GVM. Position detectors 47 and 48 are coupled to the valves to provide respective feedback signals indicative of valve position. Position detectors 47-1 through 47-N are coupled to respective throttle valves TV1–TVN and position detectors 48-1 through 48-M are coupled to respective governor valves GV1–GVM.

Control signals for operation of the valve actuation circuits are derived from a turbine control system 50 which utilizes indications of various plant parameters for control purposes. Among the various parameters utilized is an indication of throttle pressure derived from a throttle pressure detector 52 in the main steam line between the steam generating system 12 and the throttle valves. A detector 54 within the HP turbine 20 provides an indication of impulse pressure which is proportional to load, and a detector 56 in the crossover line between IP and LP turbines 22 and 24 provides an indication of crossover pressure. A power detector 60 coupled to the generator output provides a megawatt (MW) signal indicative of output electrical power. An additional input utilized by the turbine control system is an indication of speed which is obtained by speed detection circuitry 62.

In addition to controlling the valve actuation circuits for the throttle and governor valves, the turbine control system 50 is also operable to control the opening and closing of the stop valves and interceptor valves by respective valve actuation circuits 64 and 65.

Selected input signals to the turbine control system 50 from the plant, as well as output signals to the plant, are coupled to field termination networks 68 so as to provide for signal conditioning and surge voltage protection.

A block diagram of a turbine control system 50 is illustrated in FIG. 2. The system includes a controller 70*a*, having memory means for storing digital information including data and operating instructions. Digital processing circuitry is provided for processing the digital information and the controller includes means for inputting and outputting information. The reliability of the overall system may be improved by incorporating a second controller 70*b* having the identical structure as controller 70*a*.

The system is divided into several interconnecting and coordinated functional modules with each functional module incorporating its own processing capability to execute its specific function. In FIG. 2, the functional modules include valve position control (VPC) circuits 74 and 75 for controlling respective throttle valve and governor valve actuation circuits. Thus, valve position control circuits 74-1 through 74-N provide control signals to valve actuation circuits 44-1 through 44-N and constitute throttle valve position control circuits. Valve position control circuits 75-1 through 75-M control respective valve actuation circuits 45-1 through 45-M and constitute governor valve position control circuits. Although not illustrated, valve position control circuits could also be provided for the interceptor valves. Each valve position control circuit includes its own memory means for storing digital information including data and operating instructions as well as digital processing circuitry for processing the digital information, such function ideally being provided by a microcomputer.

As more fully described and claimed in copending application Ser. No. 666,761, filed Oct. 31, 1984, speed monitoring and overspeed protection is provided by a plurality of OPC circuits such as 78-1, 78-2 and 78-3, each including its own microcomputer for storing digital information including data and operating instructions as well as digital processing circuitry for processing the information. The OPC circuits are communicative with one another and are operable to interact directly with the governor valve position control circuits 75 through voting circuits 80 and gate circuit 81 to initiate a closing of all of the governor valves upon a certain predetermined condition. Valve closing may also be effected by means of an external signal applied at lead 83, such signal being for example a turbine trip signal which is provided to gate 81 and to valve position control circuits 74-1 through 74-N.

By means of two-way digital data links 85 and 86, digital information may be conveyed from the valve position control and OPC circuits to both controllers 70*a* and 70*b*, whereas only one selected controller 70*a* or 70*b* transmits digital information down to the valve position control and OPC circuits. A controller selector 90 is operable to determine which controller is the primary controller and which is the backup controller and may be further operable to selectively choose data link 85 or 86 for downward transmission of digital information.

The turbine control system additionally includes an operator's panel 96 in two-way communication with both controllers 70*a* and 70*b* as well as with all of the valve position control and OPC circuits. This latter connection enables various parameters to be communicated to the operator and allows the operator to place the system under direct manual control.

Figure 3:
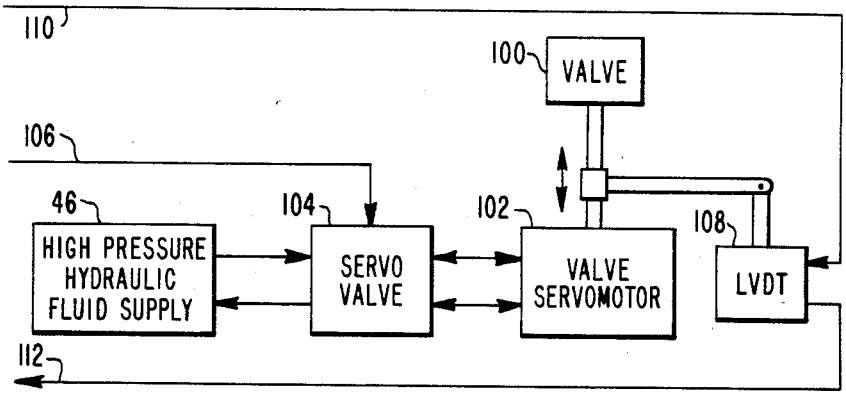
FIG. 3 is a block diagram illustrating a typical valve control arrangement.

One example of a typical valve actuation circuit which may be utilized herein is illustrated in FIG. 3. Basically, valve 100 which may represent a throttle valve, governor valve, or interceptor valve is position controlled by means of a valve servomotor 102 such as an hydraulic piston valve actuator. Movement of the piston within servomotor 102 is governed by the provision of high-pressure fluid from the hydraulic fluid system 46 as modulated by servovalve 104. A control signal on line 106 governs the movement of servovalve 104 and as a result thereof, the positioning of valve 100.

A position detector such as a linear variable differential transformer (LVDT) 108 is provided with an excitation signal on line 110 to generate, in a well-known manner, a feedback position signal on line 112 indicative of valve position.

Figure 4:
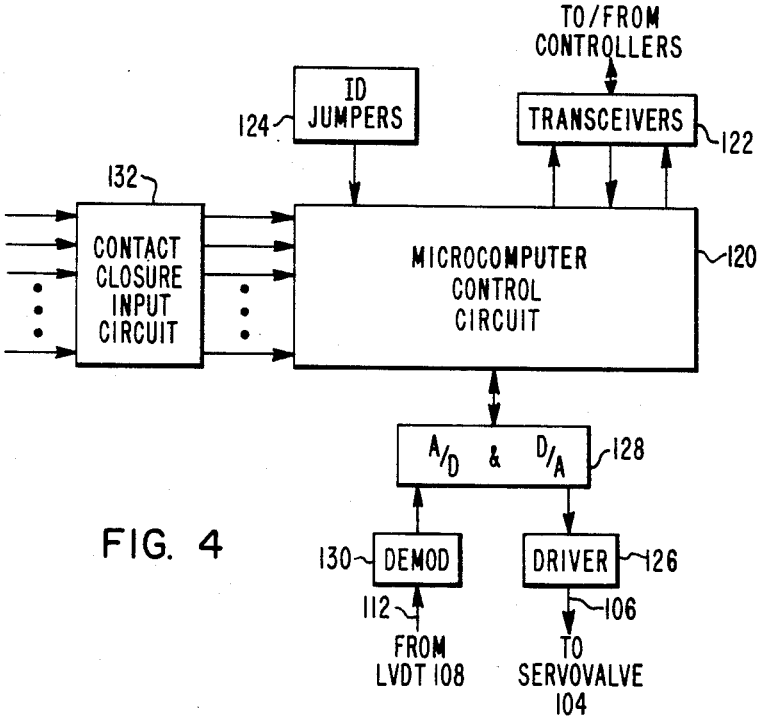
FIG. 4 is a block diagram illustrating various components of a valve position control circuit utilized in the practice of the present invention.

Each valve position control circuit contains all of the hardware, firmware and software necessary to regulate the position of an individual valve 100 be it a governor valve, throttle valve or interceptor valve. FIG. 4 shows some of the essentials of a typical valve position control circuit which may be located on a single printed circuit board and further details of which are described in the referenced patent.

At the heart of the valve position control circuit is a control means preferably in the form of a microcomputer control circuit 120 having memory for storing digital information including data and operating instructions, as well as digital processing circuitry for processing the digital information. Transceiver arrangement 122 is provided for digital information transfer between the valve position control circuit and the controller 70*a* and 70*b* via the digital data links. The primary controller may selectively communicate with one of the valve position control circuits by transmitting a particular address or identification prior to the command. Although received by all valve position control circuits as well as OPC's, only that valve position control circuit corresponding to the address will accept the command, such address or identification being previously designated by means of an identification jumper assembly 124 by which an operator may insert predetermined combinations of mini-jumper to designate whether the valve position control circuit is for governor valve, throttle valve or interceptor valve control, as well as to provide it with a specific identity. If desired, the ID jumper assembly 124 may include a channel for selective insertion of a mini-jumper to allow (or disallow) operation of the present invention to be described.

Microcomputer control circuit 120 is operative to generate a valve position control signal for the individual valve it is controlling and this signal is provided to servovalve 104 (FIG. 3) via driver 126 and line 106 after suitable conversion from digital-to-analog form by the analog-to-digital and digital-to-analog conversion circuitry 128. The LVDT signal indicative of actual valve position is provided, via line 112, to demodulator 130 and then to the microcomputer control circuit 120 after suitable conversion to digital form in the conversion circuitry 128.

Microcomputer control circuit 120 is operable to carry out operations in response to information provided by the primary controller via the digital data links when in an automatic mode of operation. Microcomputer control circuit 120 is additionally operable to receive information from the operator's panel when in a manual mode of operation and various signals initiated by the operator may be input to the microcomputer control circuit via the contract closure input circuit 132.

Figure 5:
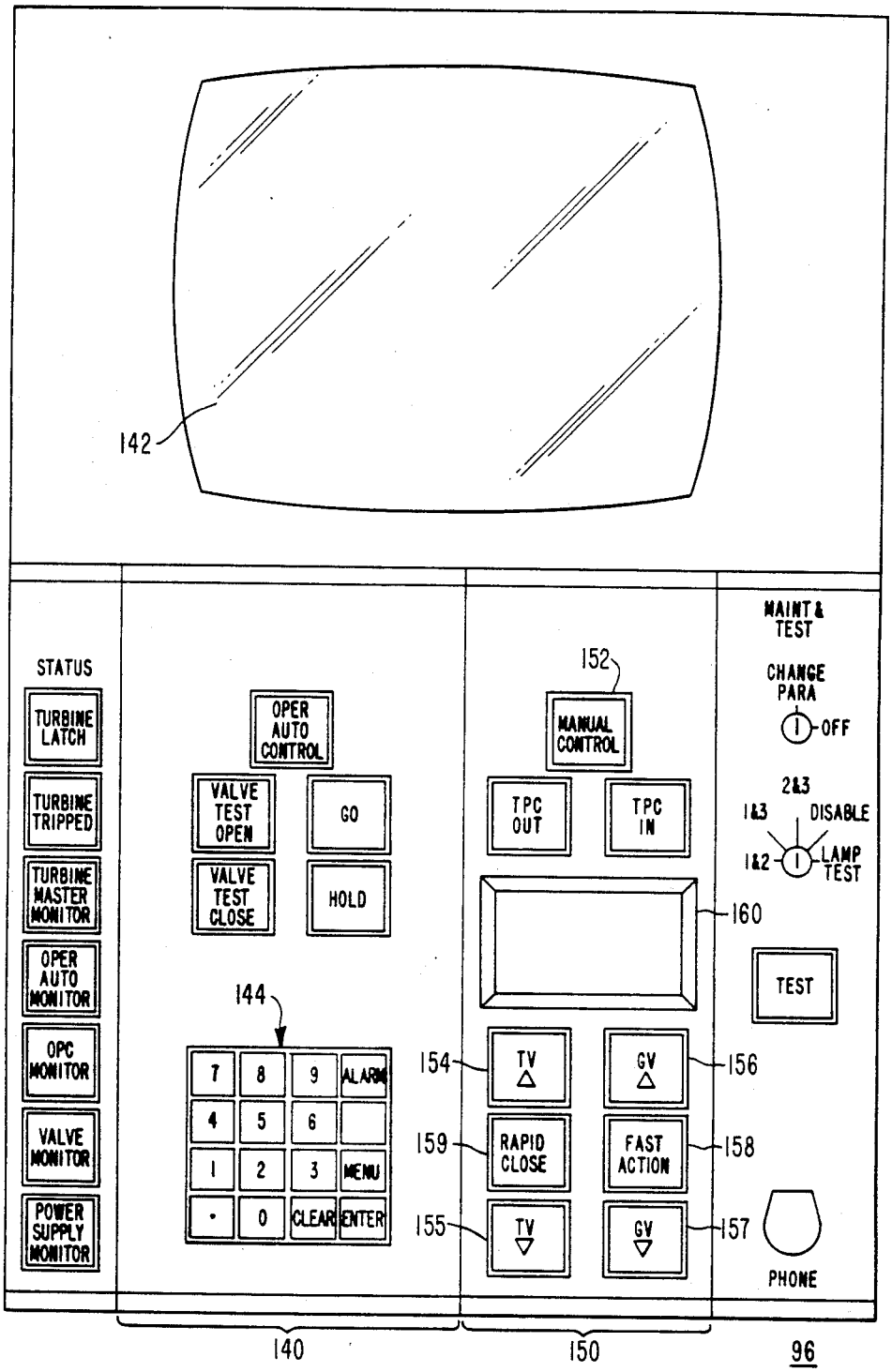
FIG. 5 illustrates the operator's panel of FIG. 2 in somewhat more detail.

A typical operator's panel is illustrated in FIG. 5 and represents an alternate form to that shown in the referenced patent in that only one level of automatic control is provided instead of two as in the patent. The automatic control section 140 is operational in conjunction with a CRT 142 and keyboard 144 for various operator interactions with the controllers 70*a* and 70*b*.

The manual section 150 is a backup control which is initiated by activation of the manual control pushbutton 152. When in the manual mode of operation, the throttle valves may be raised or lowered by means of pushbuttons 154 and 155 and the governor valves may be raised or lowered by means of pushbuttons 156 and 157. Similar pushbuttons may be provided for the interceptor valves in those systems wherein the interceptor valves have their own individual valve position control circuits as previously described. The raising and lowering of the valves will be at a predetermined rate such as 5% per minute and a predetermined faster rate such as 33⅓% per minute may be achieved with the additional activation of a fast action pushbutton 158. For emergency situations it may be desirable to rapidly close the valve, for example at a rate of 200% per minute and a rapid close pushbutton 159 is provided for this purpose. Activation of the pushbuttons of the manual section input a corresponding signal directly into all of the valve position control circuits as illustrated in FIG. 4, via the respective contact closure input circuit 132. A readout 160 may be provided for the selective display of various parameters.

Figure 6:
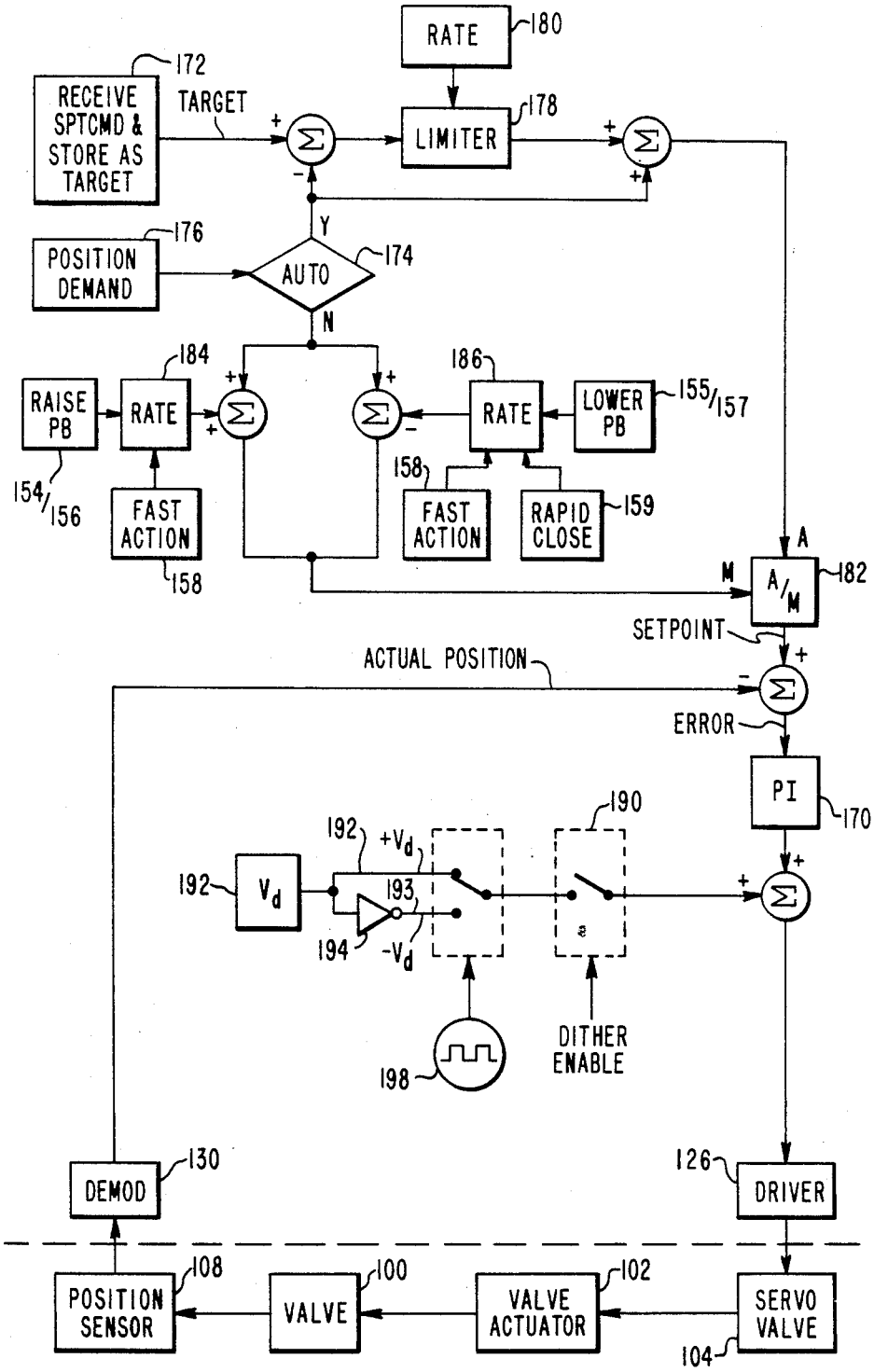
FIG. 6 is a block diagram functionally illustrating the operation of the present invention.

FIG. 6 is a block diagram conceptually showing operation of the present invention in conjunction with operation of a valve position control circuit in controlling a governor valve. The Figure includes previously described components as well as functions performed by the microcomputer control circuit.

A proportional plus integral (PI) controller 170 generates a valve position control signal for driver 126 in response to an input error signal derived from the difference between a setpoint valve and the valve's actual position as provided by the position sensor. The PI routine is well known and is performed, for example, every 4 milliseconds (250 times a second) for smooth valve movement.

The valve setpoint is changed according to a certain rate toward a valve target position sent down the digital data link as a setpoint command and stored in the memory of the microcomputer of the valve position control circuit, as indicated by block 172.

If operation is in the automatic mode as indicated by block 174 (AUTO?=Y) then a position demand signal friom block 176 is subtracted from the target value and the result provided to high limiter 178 which also receives a predetermined rate input from block 180 and passes the lower of the two values. The position demand signal of block 176 may be the previously calculated position reference setpoint or may be a commanded value by way of example. The position demand signal from block 176 is also added to the output of limiter 178 and passed through the auto/manual selector block 182 to constitute a new setpoint which, by way of example, may be updated every 250 milliseconds (4 times per second).

When in the manual mode (AUTO?=N) the setpoint may remain the same or may be increased or decreased by activation of the pushbuttons of the control panel's manual section. Thus, if the raise pushbutton 154 or 156 is activated, the old setpoint from position demand block 176 will be increased such that the valve will normally raise at a rate of 5% per minute toward the fully opened position, as determined by rate block 184. If fast action pushbutton 158 is activated, the rate of opening will be increased, such as to a value of 33.3% per minute toward the fully opened position.

If the valve is to be lowered, in accordance with activation of pushbutton 155 or 157, the old setpoint is decreased and the lowering is at a predetermined rate of 5% per minute as determined by rate block 186, or with activation of pushbutton 158, the faster 33.3% rate will be effected. For the closing operation a third rate may be imposed as determined by activation of pushbutton 159 to close the valve at a rate of 200% per minute toward the fully closed position. An indication of manual operation as well as the inputs from all of the pushbuttons are communicated to the microcomputer control circuit 120 through the contact closure circuit 132 of FIG. 4.

Whether in an automatic or manual mode of operation, the PI controller 170 is provided with an error signal which is the result of the difference between the setpoint and the actual valve position to generate a valve position control signal. This signal moves the valve toward the setpoint value so as to reduce the error to zero, after which a new setpoint may be generated to again cause movement of the valve with the operation continuing in this manner until the valve reaches the commanded target position. During the course of operation however a situation may arise wherein the servo valve 104 becomes stuck due to possible dirt contamination in the hydraulic fluid supply. In such instance, the actual valve position will not change since it is not moving thus causing the error signal to the PI controller 170 to build up as the setpoint changes. In the present invention, if the error, or mismatch, exceeds a first predetermined value for a predetermined period of time, then a minor mismatch is indicated and correction dithering action is undertaken in an attempt to unstick the servo valve.

Basically, the dithering action will superimpose an oscillatory signal on the PI control signa to oscillate the clogged servo valve in an attempt to work the particulate matter out of a clogged orifice in the servo valve.

Figure 7:
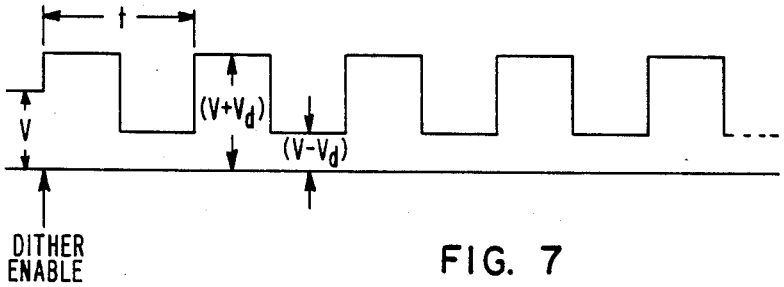
FIG. 7 illustrates a waveform for controlling a steam valve under certain circumstances.

When the error buildup indicates that a dithering action should take place, a dither enable signal is provided having the effect of closing switch 190. The dithering, or oscillatory signal is conceptionally illustrated as being provided by a voltage source 192 which provides a voltage of $+V_d$ on line 192 and a voltage of $-V_d$ on line 193 due to inversion circuit 194. Oscillator 198 switches between lines 192 and 193 so as to provide a square wave dithering signal which is added to the PI control signal. By way of example, FIG. 7 illustrates the PI signal to the driver, in response to a particular setpoint. Just prior to dither enable the value as provided by the PI controller is of a magnitude V and subsequent to dither enable, a square wave of period t is superimposed on the control signal such that its magnitude varies from $(V+V_d)$ to $(V-V_d)$. As an example, period t may be 8 milliseconds and the peak-to-peak voltage of the dithering signal may be 25% of the full output control signal necessary to drive the valve from a fully closed to a fully opened position. If the full range control signal is 10 volts, the dithering signal therefore would be 2.5 volts peak-to-peak.

The presence of a major mismatch indicates that a clogging particle has not been dislodged or it may indicate a failure in the position measuring apparatus or other circuit components. In such instance the valve may be shut down by commanding a zero valued setpoint which causes a negative 5 volt signal to be applied so as to close the valve (zero volts actually closes it) and after several seconds the backseating voltage is reduced to half its value, to negative 2.5 volts to reduce heat dissipation. The setpoint value just prior to initiation of backseating is memorized so that the valve may return to its original position after recovery or corrective action has taken place. The governor valve dithering and backseating operation performed by the microcomputer control circuit is illustrated by the flow chart of FIG. 8 to which reference is now made.

Figure 8:
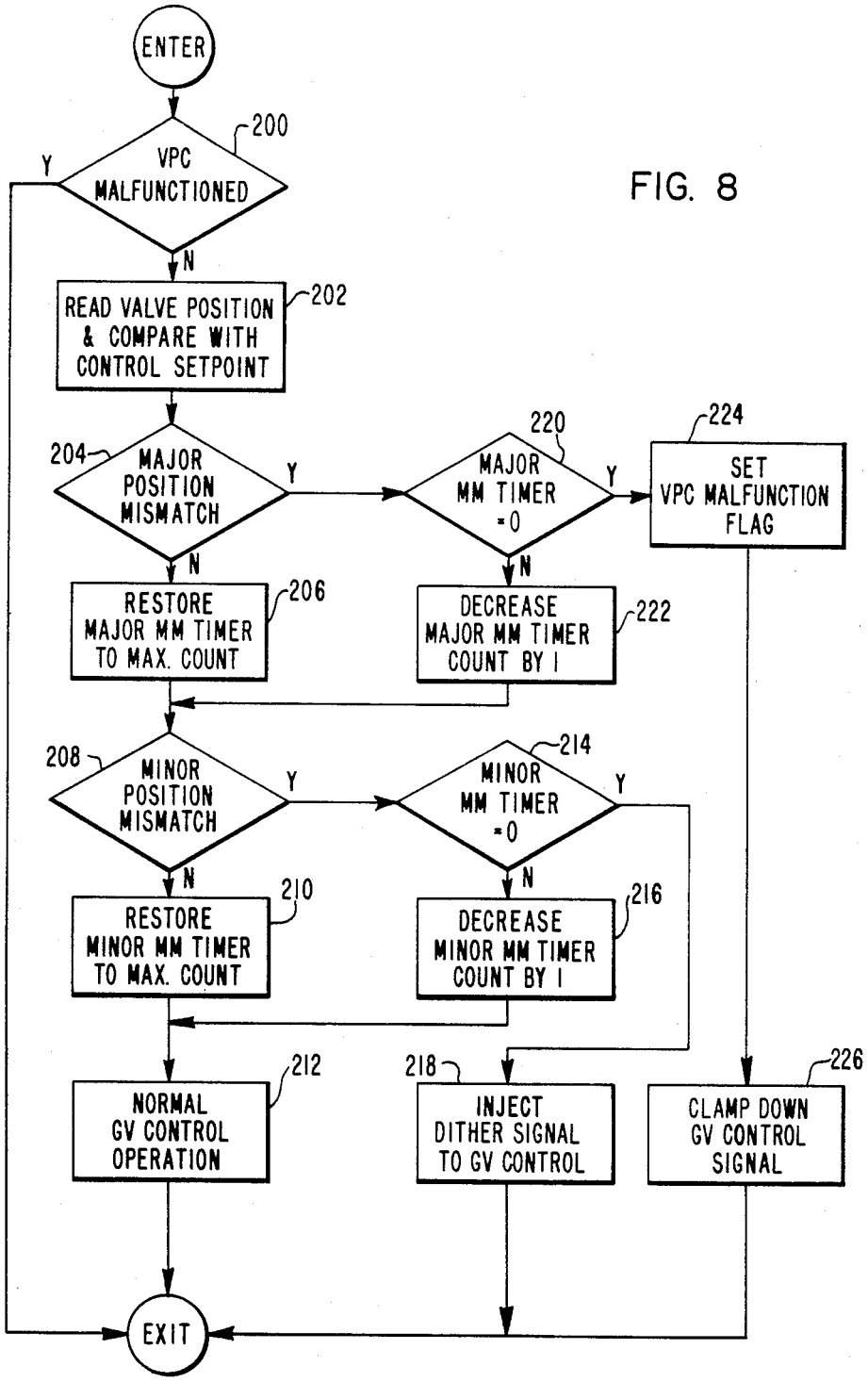
FIG. 8 is a flow chart illustrating the microcomputer control of the present invention.

Initially, as indicated by decision block 200, the determination is made as to whether or not the valve position control circuit has malfunctioned, in which case the routine depicted in FIG. 8 is bypassed.

If the valve position control circuit is operational, then the actual valve position is compared with the setpoint, as indicated by block 202, and if the difference exceeds a first predetermined value, indicating a minor mismatch, a first course of action is taken, and if the difference exceeds a second and higher predetermined value indicating a major mismatch, a second course of action is taken. In a typical embodiment if the difference is equal to or greater than 10% of full scale then a minor mismatch is indicated, and if the difference is equal to or greater than 25% of full scale then a major mismatch is indicated. For example, if the setpoint calls for a 100% opening and the actual valve position is equal to or less than 75% open, then a major mismatch condition exists. If the setpoint happens to call for a 5% opening and the valve is actually equal to or greater than 30% open, then a major mismatch also exists. A minor mismatch exists by way of example if the setpoint calls for a 50% opening and the valve is actually equal to or greater than 60% open or equal to or less than 40% open. That is, any difference equal to or greater than 10% of full scale (100%) indicates a minor mismatch, and anything equal to or greater than 25% of full scale equals a major mismatch, although the trigger values of 10 and 25 are given merely by way of example.

First and second timers designated as a major mismatch timer and a minor mismatch timer are established and initially set to some count such as their maximum count. Decision block 204 determines the path as a function of whether or not a major mismatch exists. Let it be assumed that a major mismatch does not exist in which case the major mismatch timer is restored to its maximum count as indicated by block 206. In the present example the major mismatch timer (as well as the minor mismatch timer) is already at its maximum count.

Decision block 208 then determines the path depending upon whether or not there is a minor mismatch, and assuming such minor mismatch does not exist the minor mismatch timer is also restored to its maximum count as indicated by block 210 and normal governor valve control operation is maintained by the microcomputer control circuit, as indicated by block 212.

Let it be assumed that a minor mismatch now occurs. The path from decision block 208 then leads to decision block 214 to determine whether the count of the minor mismatch timer is zero. Since the minor mismatch timer was restored to its maximum count on the previous execution, the count is not zero and is decremented by one by the operation of block 216, however, normal operation is still in effect. Upon each execution of the routine the minor mismatch timer is decremented by one until such time that its count does equal zero in which case the path from decision block 214 leads to the operation of block 218 wherein the dithering process previously explained is initiated. Accordingly, depending upon the execution frequency of the routine of FIG. 8, and the minor mismatch timer maximum count, the dither operation will be commenced only after a minor mismatch has been in effect for a predetermined period of time, which by way of example may be one second. The dithering operation itself may consist of applying the dithering signal for a predetermined period of time, such as ten seconds, by way of example, after which the signal is removed for a like period of time and thereafter the process repeated.

If the dithering operation does not correct the situation, a point will be reached wherein a major mismatch is indicated in which case the path from decision block 204 will lead to decision block 220 to see if the major mismatch timer count is zero. Since it is not zero due to the previous execution, its count will be decremented by one as indicated by block 222. With each execution the maximum count is decremented by one, and when the count is zero the path from decision block 220 will lead to block 224 which sets a malfunction flag in the valve position control circuit, such as by setting a special flip-flop, which when set causes the valve to be closed in accordance with the operation of block 226. The operation of block 226 may fix the setpoint value to zero to thereby initiate the backseating operation previously described. The malfunction flag can be utilized to indicate a malfunction to the operator, and the routine of FIG. 8 is bypassed to allow corrective servicing to be performed after which a reset button may be activated to place the valve position control circuit back into operation.

What we claim is:

1. An improved steam inlet valve control system for a steam turbine, comprising:
(A) control means for providing a control signal to govern the opening and closing of said valve; and
(B) means for superimposing an oscillatory signal on said control signal if said valve gets stuck.

2. Apparatus according to claim 1 wherein
(A) said oscillatory signal is superimposed only after said valve has been stuck for a predetermined period of time.

3. Apparatus according to claim 1 wherein
(A) said oscillatory signal is a squarewave.

4. Apparatus according to claim 1 wherein
(A) the magnitude of said oscillatory signal is less than the full scale range of said control signal.

5. Apparatus according to claim 4 wherein
(A) said oscillatory signal is 25% of the full scale range of said control signal.

6. Apparatus according to claim 1 wherein
(A) the period of said oscillatory signal is in the millisecond range.

7. An improved steam inlet valve control system for a steam turbine, comprising
(A) control means including a controller for providing a control signal to govern the opening and closing of said valve;
(B) means for providing a valve opening setpoint signal;
(C) sensing means operable to provide a position signal indicative of the actual position of said valve;
(D) said control means being operable to provide said control signal as a function of the difference between said setpoint signal and said position signal; and
(E) means for superimposing an oscillatory signal on said control signal if said difference exceeds a first predetermined value.

8. Apparatus according to claim 7 wherein
(A) said oscillatory signal is superimposed only after said difference exceeds said first predetermined value for a first predetermined period of time.

9. Apparatus according to claim 7 wherein
(A) said oscillatory signal is a square wave.

10. Apparatus according to claim 7 wherein
(A) said controller is a proportional plus integral controller.

11. Apparatus according to claim 7 wherein
(A) said control means is operable to close said valve if said difference exceeds a second predetermined value.

12. Apparatus according to claim 10 wherein
(A) said closure is effected only after said difference exceeds said second predetermined value for a second predetermined period of time.

13. Apparatus according to claim 12 wherein
(A) said second predetermined period of time is greater than said first predetermined period of time.

14. Apparatus according to claim 11 wherein
(A) said control means is operable to apply a closure signal to effect said valve closure, said closure signal being greater than normally required, so as to backseat said valve.

15. In a steam turbine system having a plurality of throttle valves and governor valves for admitting steam, an improved valve control arrangement, comprising:
(A) at least a first digital computer means for generating a plurality of valve setpoint commands;
(B) a plurality of valve position control circuits in two-way data communication with said first digital computer means and each including its own digital computer means for generating respective valve control signals in response to receipt of a setpoint command from said first digital computer means;
(C) each said digital computer means of said valve position control circuits being operable to provide an oscillatory control signa to its respective valve if said valve gets stuck.

16. Apparatus according to claim 15 wherein
(A) said oscillatory signal is cyclically applied in an attempt to cyclically oscillate the valve to unstick it.

17. Apparatus according to claim 16 wherein
(A) sid digital computer means of said valve position control signal is operable to close its respective valve if said attempt is unsuccessful.

* * * * *